US011436978B2

(12) United States Patent
Fan et al.

(10) Patent No.: US 11,436,978 B2
(45) Date of Patent: Sep. 6, 2022

(54) PIXEL CIRCUIT AND DISPLAY DEVICE

(71) Applicant: HEFEI VISIONOX TECHNOLOGY CO., LTD., Anhui (CN)

(72) Inventors: Longfei Fan, Hefei (CN); Longyan Wang, Hefei (CN); Pei Duan, Hefei (CN); Hui Zhu, Hefei (CN); Zhenzhen Han, Hefei (CN); Siming Hu, Hefei (CN); Lu Zhang, Hefei (CN); Jianlong Wu, Hefei (CN)

(73) Assignee: HEFEI VISIONOX TECHNOLOGY CO., LTD., Hefei (CN)

( * ) Notice: Subject to any disclaimer, the term of this patent is extended or adjusted under 35 U.S.C. 154(b) by 0 days.

(21) Appl. No.: 17/349,293

(22) Filed: Jun. 16, 2021

(65) Prior Publication Data

US 2021/0312866 A1 Oct. 7, 2021

Related U.S. Application Data

(63) Continuation of application No. PCT/CN2019/119497, filed on Nov. 19, 2019.

(30) Foreign Application Priority Data

May 21, 2019 (CN) ..... 201910425396.7

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01); *G09G 2320/0214* (2013.01)

(58) Field of Classification Search
CPC .... G09G 3/3233; G09G 3/3241; G09G 3/325; G09G 3/3258; G09G 2300/0842; G09G 2320/0214; G09G 2300/0819
(Continued)

(56) References Cited

U.S. PATENT DOCUMENTS

2015/0049126 A1* 2/2015 Jung ..... G09G 3/3233 315/172
2015/0054799 A1* 2/2015 Chang ..... H01L 27/3262 345/204
(Continued)

FOREIGN PATENT DOCUMENTS

CN 102063861 B 1/2016
CN 106023889 A 10/2016
(Continued)

OTHER PUBLICATIONS

International Search Report dated Jan. 23, 2020 in corresponding International application No. PCT/CN2019/119497; 6 pages.
(Continued)

*Primary Examiner* — Tom V Sheng
(74) *Attorney, Agent, or Firm* — Maier & Maier, PLLC

(57) ABSTRACT

A pixel circuit includes a light-emitting module, a drive module configured to drive the light-emitting module to emit light according to a voltage of a control terminal of the drive module, a storage module configured to store the voltage of the control terminal of the drive module, and a leakage current suppression module electrically connected to the control terminal of the drive module and configured to maintain a potential of the control terminal of the drive module.

15 Claims, 16 Drawing Sheets

(58) Field of Classification Search
USPC ..... 345/204
See application file for complete search history.

(56) References Cited

U.S. PATENT DOCUMENTS

| | | | | |
|---|---|---|---|---|
| 2015/0243203 | A1* | 8/2015 | Kim | G09G 3/3291 345/212 |
| 2017/0140724 | A1* | 5/2017 | Lin | G09G 3/3233 |
| 2017/0186782 | A1* | 6/2017 | Lee | H01L 27/1225 |
| 2019/0035322 | A1* | 1/2019 | Kim | G09G 3/3266 |
| 2019/0214447 | A1* | 7/2019 | Kim | H01L 27/3262 |
| 2019/0259785 | A1* | 8/2019 | Lee | H01L 29/78675 |
| 2019/0371237 | A1* | 12/2019 | Qian | G09G 3/3266 |
| 2020/0302859 | A1* | 9/2020 | Wang | G09G 3/325 |
| 2021/0012712 | A1* | 1/2021 | Lin | G09G 3/3291 |

FOREIGN PATENT DOCUMENTS

| | | | |
|---|---|---|---|
| CN | 106531075 | A | 3/2017 |
| CN | 106783921 | A | 5/2017 |
| CN | 107564468 | A | 1/2018 |
| CN | 107680537 | A | 2/2018 |
| CN | 108470539 | A | 8/2018 |
| CN | 108806610 | A | 11/2018 |
| CN | 108986742 | A | 12/2018 |
| CN | 109119027 | A | 1/2019 |
| CN | 109523956 | A | 3/2019 |
| CN | 110264946 | A | 9/2019 |
| CN | 110277060 | A | 9/2019 |

OTHER PUBLICATIONS

Chinese First Search dated Mar. 3, 2020 in corresponding application No. 201910425396.7; 2 pages.
Chinese Office Action dated Mar. 11, 2020 in corresponding application No. 201910425396.7; 15 pages.
Chinese Office Action dated Jul. 23, 2020 in corresponding application No. 201910425396.7; 13 pages.
Chinese Office Action dated Nov. 17, 2020 in corresponding application No. 201910425396.7; 10 pages.
Chinese Notice of decision of rejection dated Mar. 2, 2021 in corresponding application No. 201910425396 7; 12 pages.
Chinese Supplementary Search dated Feb. 10, 2021 in corresponding application No. 201910425396.7; 1 page.

* cited by examiner

PIXEL CIRCUIT AND DISPLAY DEVICE

CROSS REFERENCE TO RELATED APPLICATIONS

This application is a continuation of International Patent Application No. PCT/CN2019/119497, filed on Nov. 19, 2019, which is based on and claims priority to Chinese Patent Application No. 201910425396.7 filed with the CNIPA on May 21, 2019, disclosures of which are incorporated herein by reference in their entireties.

TECHNICAL FIELD

Embodiments of the present application relate to the field of display technology, for example, to a pixel circuit and a display device.

BACKGROUND

With the development of display technology, organic light-emitting display devices are becoming more widely used.

An organic light-emitting display device includes multiple pixel circuits. Each pixel circuit usually includes multiple thin-film transistors. In a pixel circuit in the related art, a thin-film transistor electrically connected to a drive transistor usually has a relatively large leakage current, resulting in an unstable gate potential of the drive transistor and a relatively large power consumption of the display device.

SUMMARY

The present application provides a pixel circuit and a display device so that the potential of the control terminal of a drive module can be stabilized and the power consumption of the display device can be reduced.

An embodiment of the present application provides a pixel circuit. The pixel circuit includes a light-emitting module, a drive module, a storage module and a leakage current suppression module.

The drive module is configured to drive, according to the voltage of the control terminal of the drive module, the light-emitting module to emit light.

The storage module is configured to store the voltage of the control terminal of the drive module.

The leakage current suppression module is electrically connected to the control terminal of the drive module and is configured to maintain the potential of the control terminal of the drive module.

An embodiment of the present application further provides a display device. The display device includes the pixel circuit provided in the present application, and further includes a drive chip electrically connected to the pixel circuit.

BRIEF DESCRIPTION OF DRAWINGS

FIG. 2 shows that the leakage current suppression module of FIG. 1 includes a control terminal G2, a first terminal and a second terminal. The first terminal of the leakage current suppression module is electrically connected to the data voltage input terminal Vdata of the pixel circuit.

The control terminal G2 of the leakage current suppression module is electrically connected to the first scan signal input terminal Scan1 of the pixel circuit.

Figure 2:
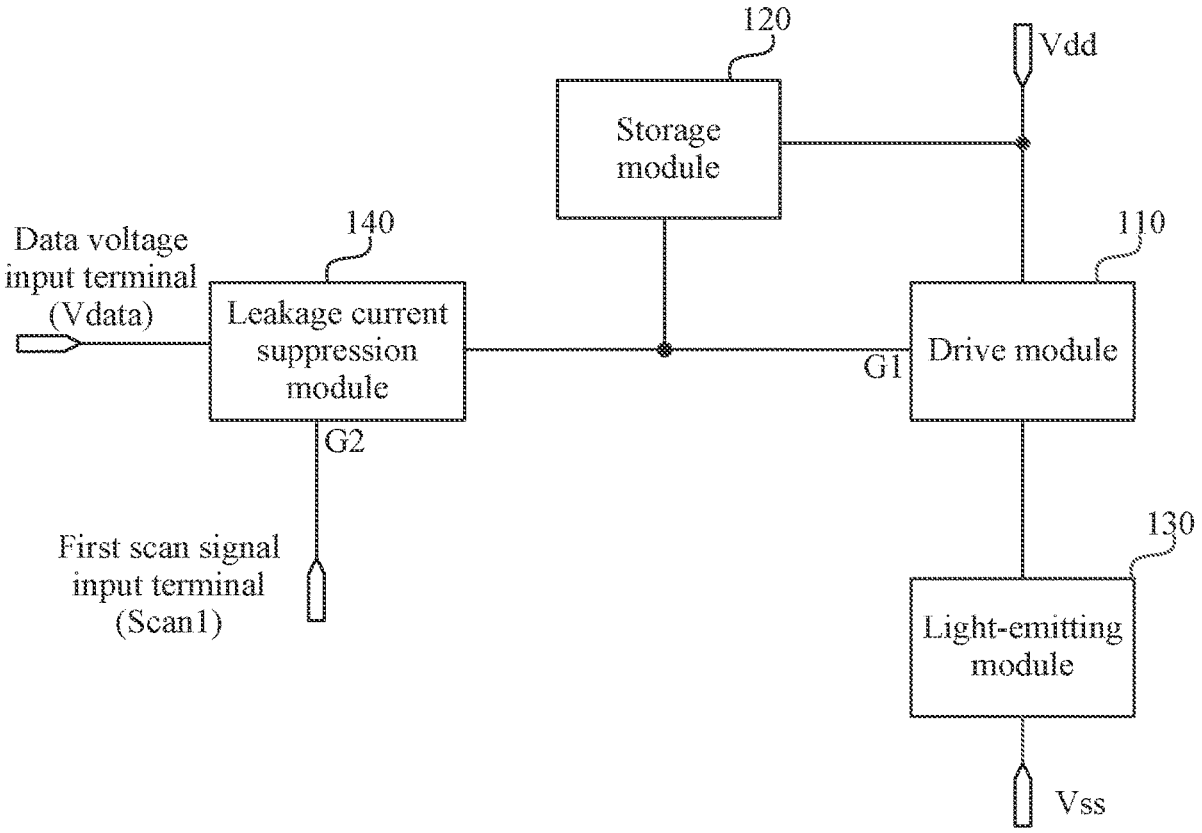
FIG. 2 is a structure diagram of another pixel circuit according to an embodiment of the present application, where
Figure 3:
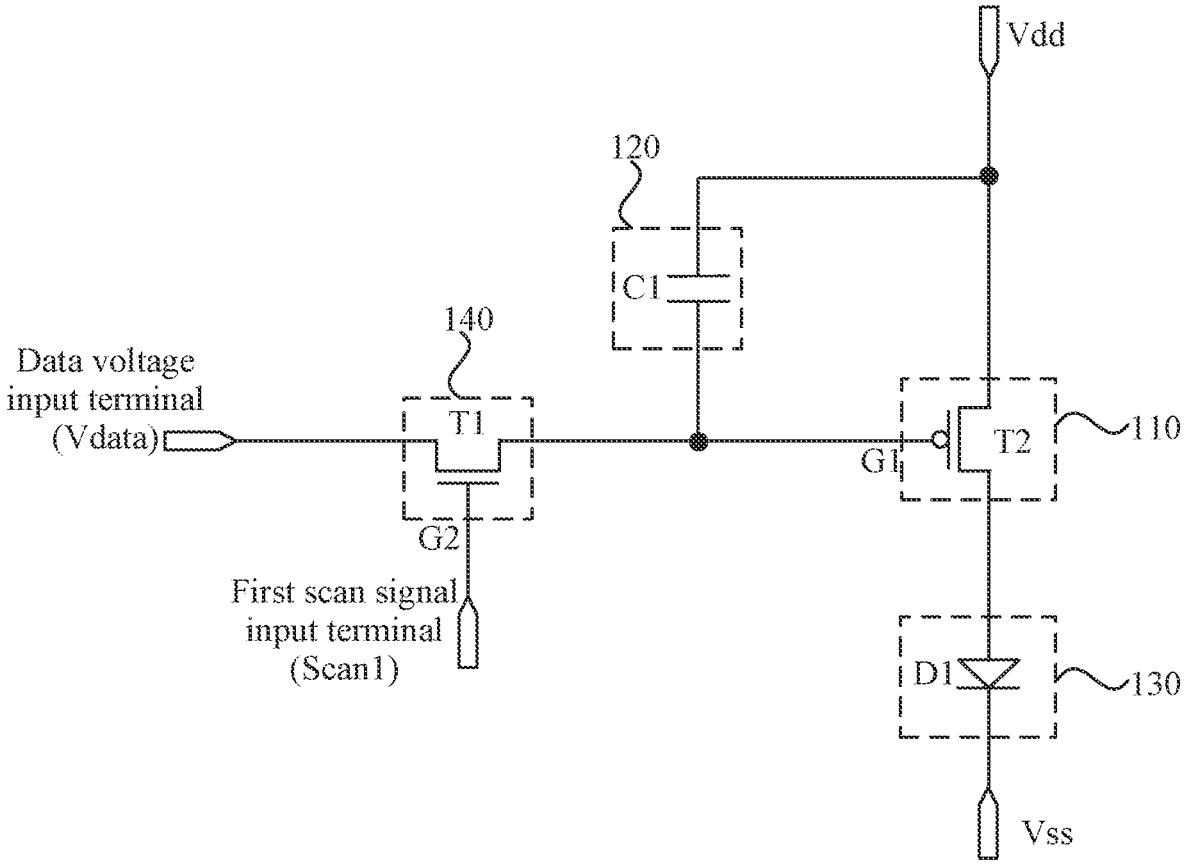

FIG. 3 is a structure diagram of another pixel circuit according to an embodiment of the present application, where FIG. 3 shows that the leakage current suppression module of FIG. 2 includes a first transistor T1. The drive module includes a second transistor T2. The storage module includes a first capacitor C1. The light-emitting module includes an organic light-emitting diode D1.

Figure 4:
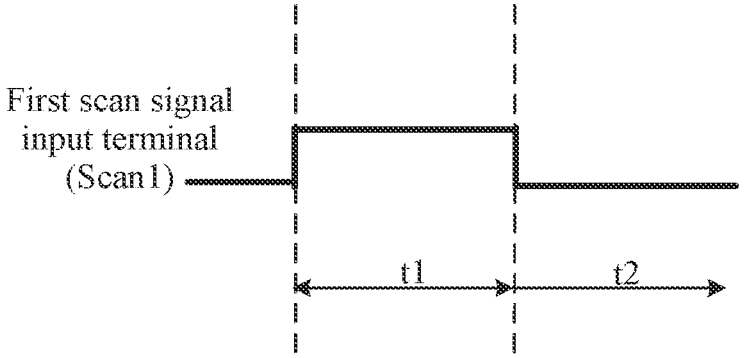

FIG. 4 is an operational timing diagram of the pixel circuit in FIG. 3 according to an embodiment of the present application.

Figure 5:
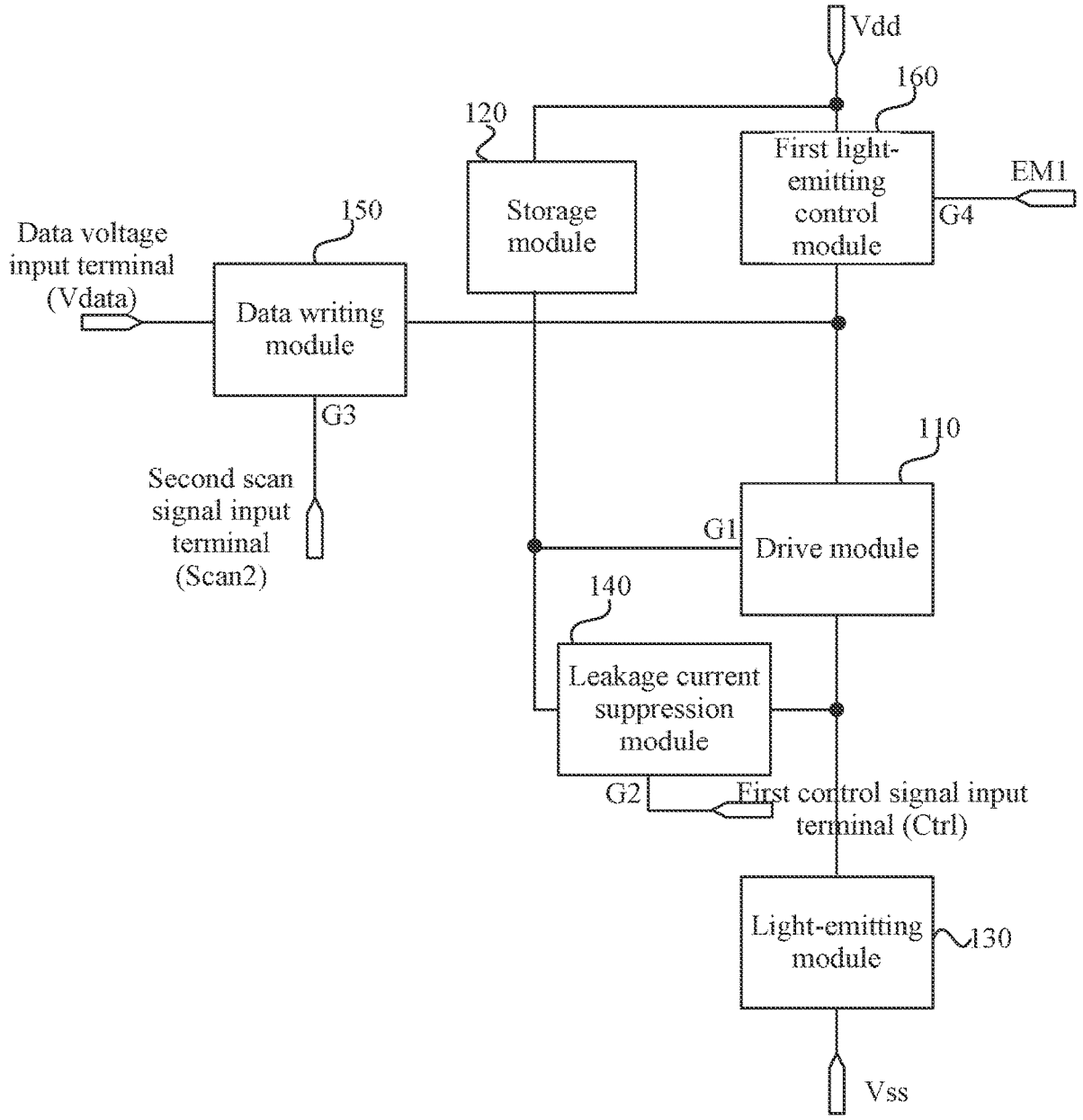

FIG. 5 is a structure diagram of another pixel circuit according to an embodiment of the present application, where FIG. 5 shows that the pixel circuit of FIG. 2 further includes a data writing module and a first light-emitting control module.

Figure 6:
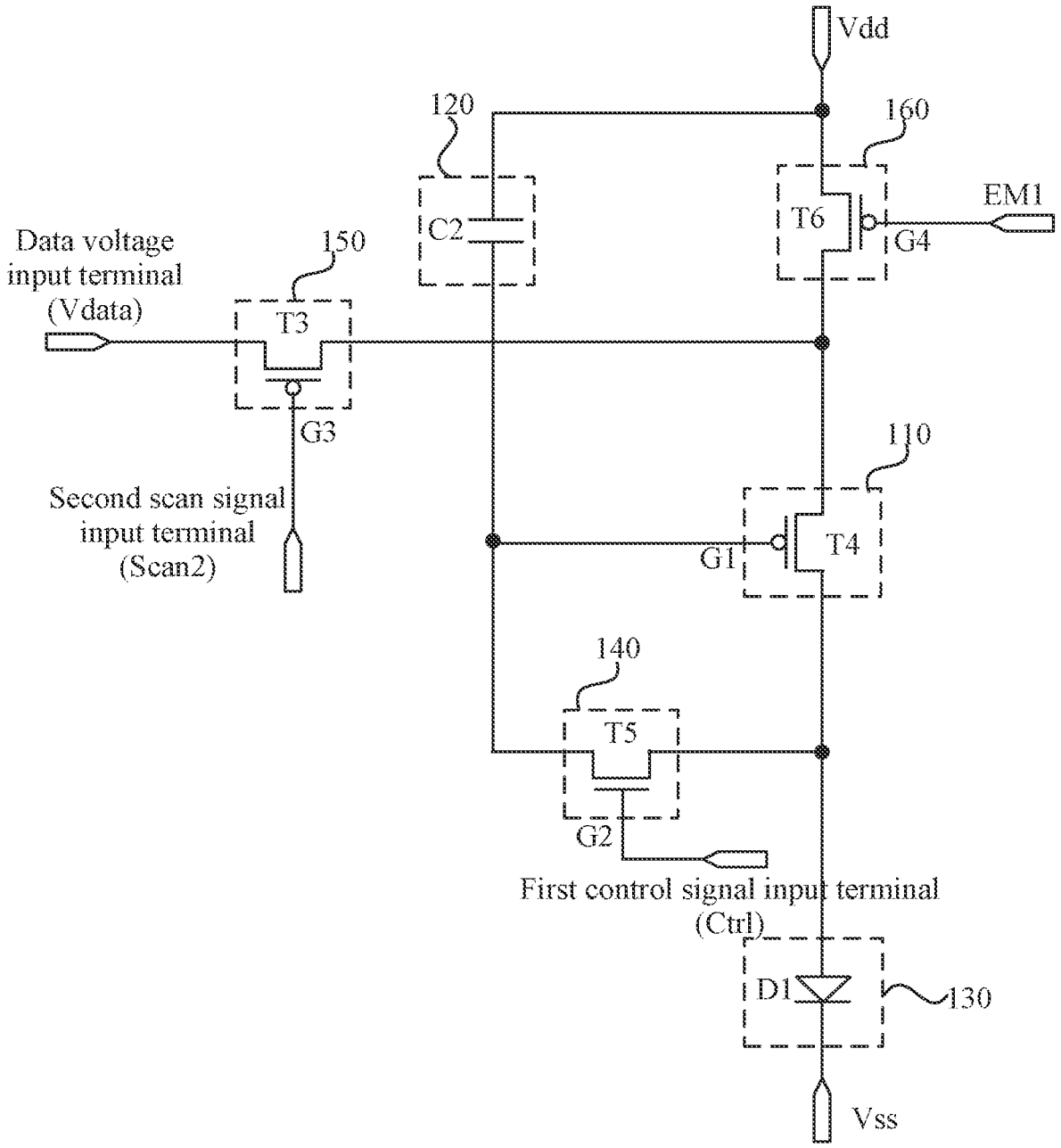

FIG. 6 is a structure diagram of another pixel circuit according to an embodiment of the present application, where FIG. 6 shows that based on the pixel circuit in FIG. 5, the data writing module includes a third transistor T3, the drive module includes a fourth transistor T4, the leakage current suppression module includes a fifth transistor T5, the first light-emitting control module includes a sixth transistor T6, the storage module includes a second capacitor C2, and the light-emitting module includes an organic light-emitting diode D1.

Figure 7:
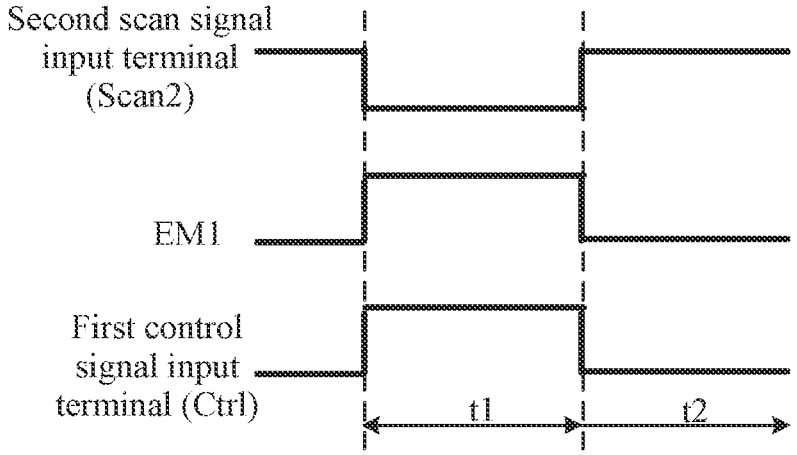

FIG. 7 is an operational timing diagram of the pixel circuit of FIG. 6 according to an embodiment of the present application.

Figure 8:
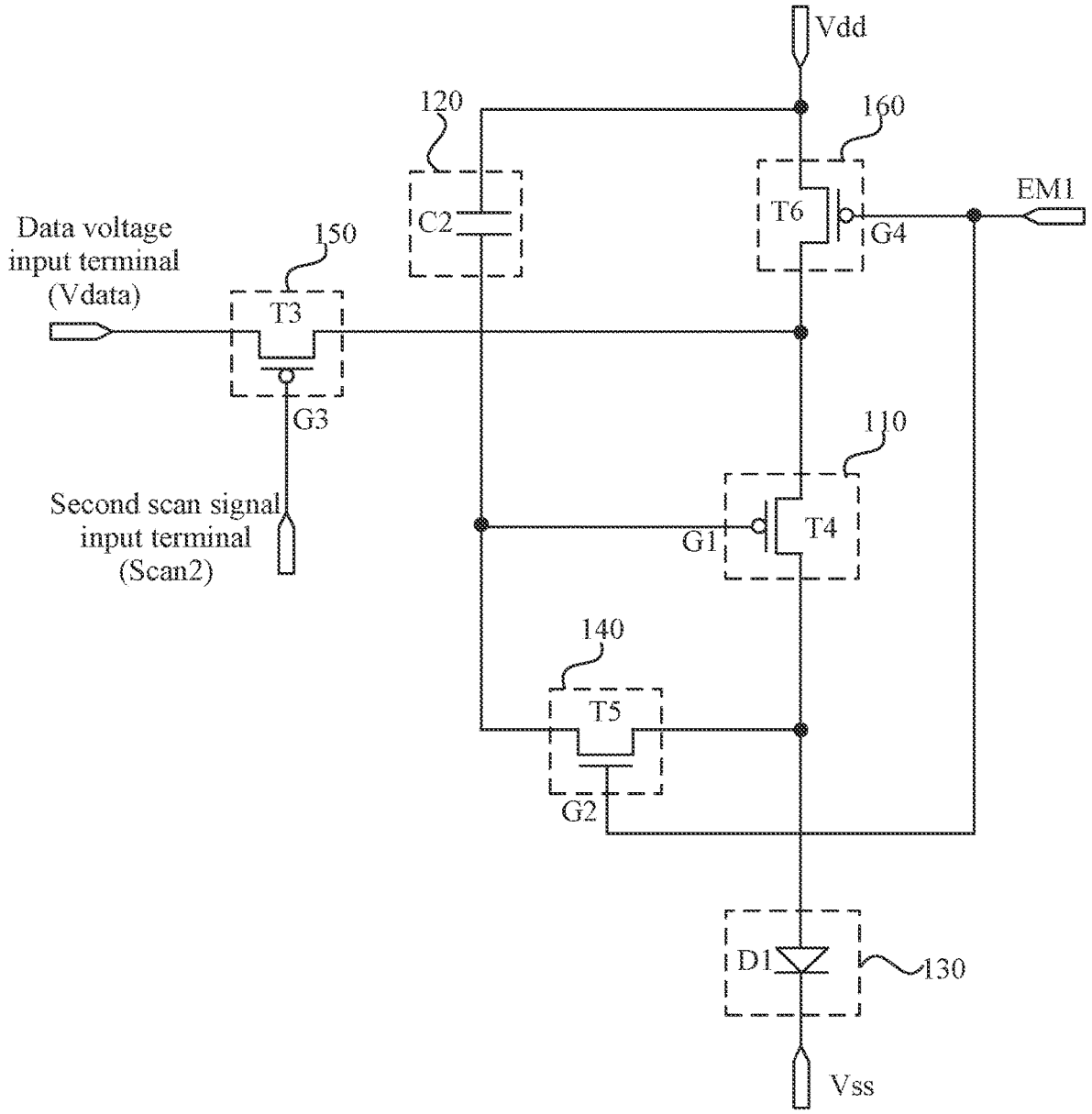

FIG. 8 is a structure diagram of another pixel circuit according to an embodiment of the present application, where FIG. 8 shows that based on the pixel circuit in FIG. 6, the channel type of the fifth transistor T5 is different from the channel type of the sixth transistor T6, and the gate of the fifth transistor T5 is electrically connected to the first light-emitting control signal input terminal EM1 of the pixel circuit.

Figure 9:
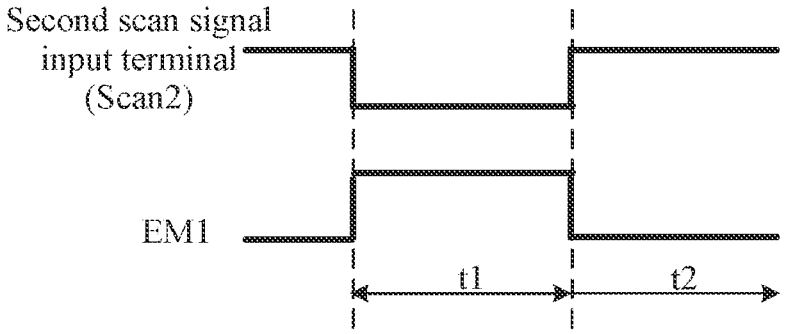

FIG. 9 is an operational timing diagram of the pixel circuit of FIG. 8 according to an embodiment of the present application.

Figure 10:
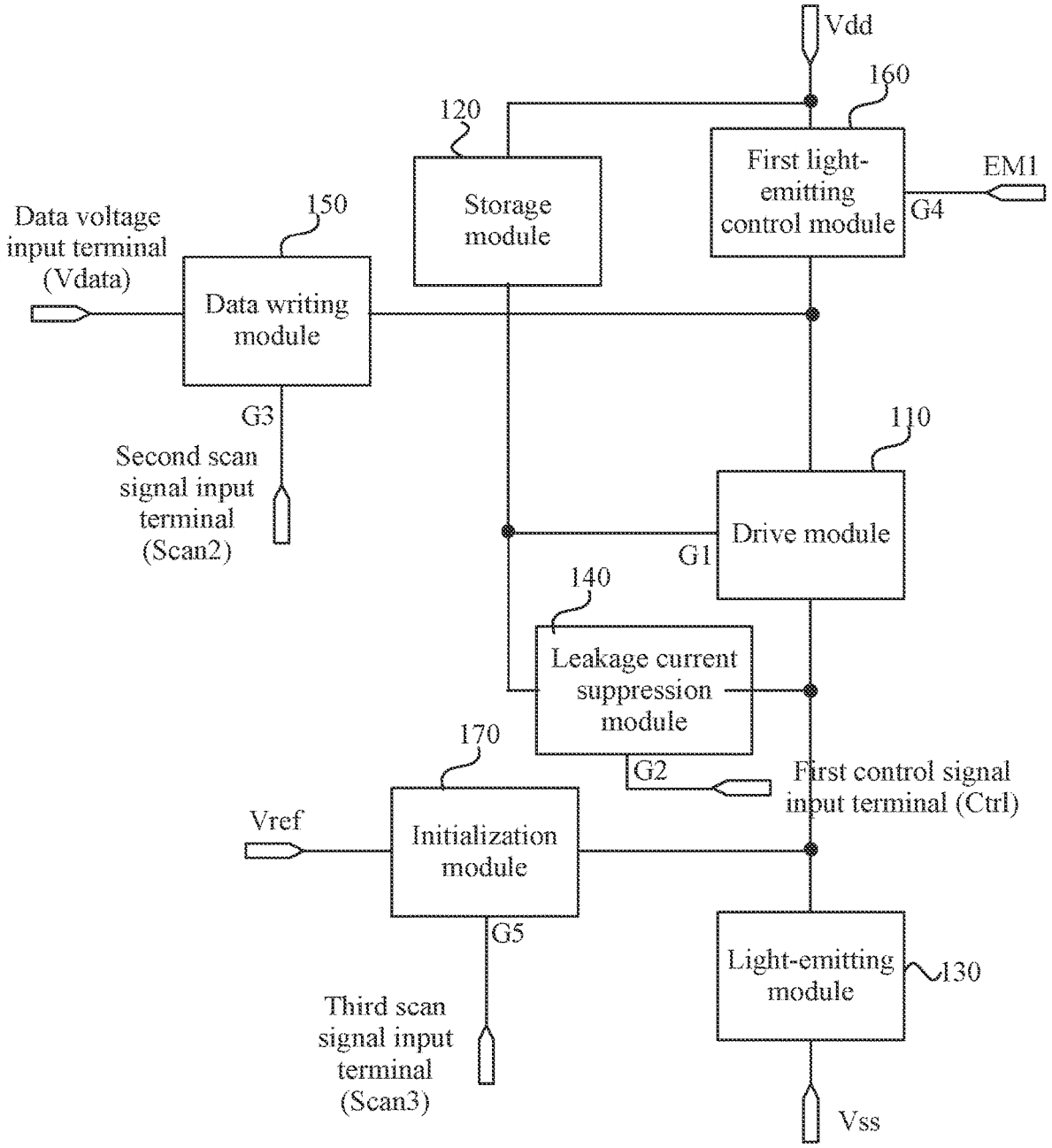

FIG. 10 is a structure diagram of another pixel circuit according to an embodiment of the present application, where FIG. 10 shows that the pixel circuit of FIG. 5 further includes an initialization module based on the pixel circuit of FIG. 5. The initialization module includes a control terminal G5, a first terminal and a second terminal.

Figure 11:
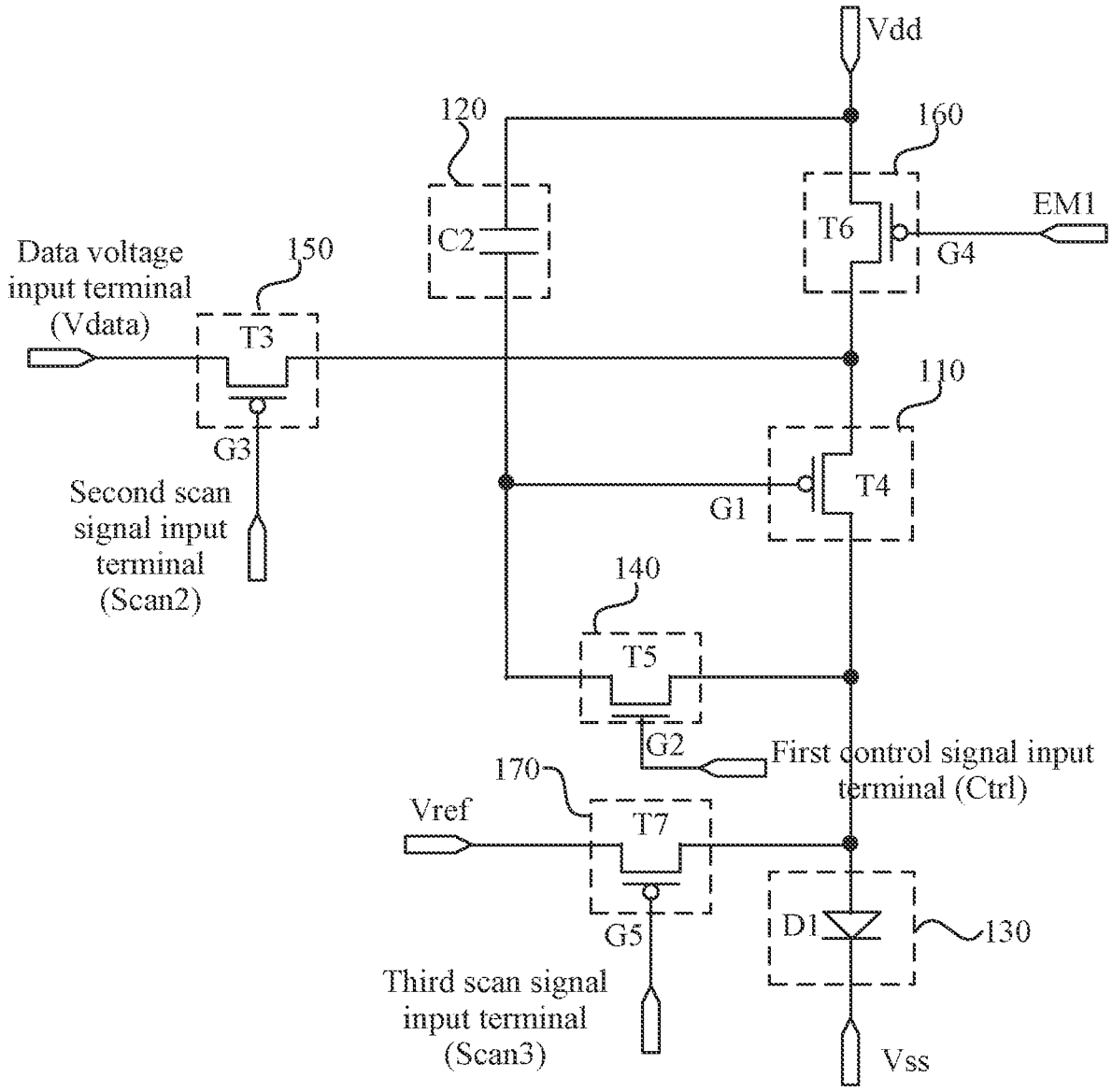

FIG. 11 is a structure diagram of another pixel circuit according to an embodiment of the present application, where FIG. 11 shows that the initialization module of the pixel circuit of FIG. 10 includes a seventh transistor T7.

Figure 12:
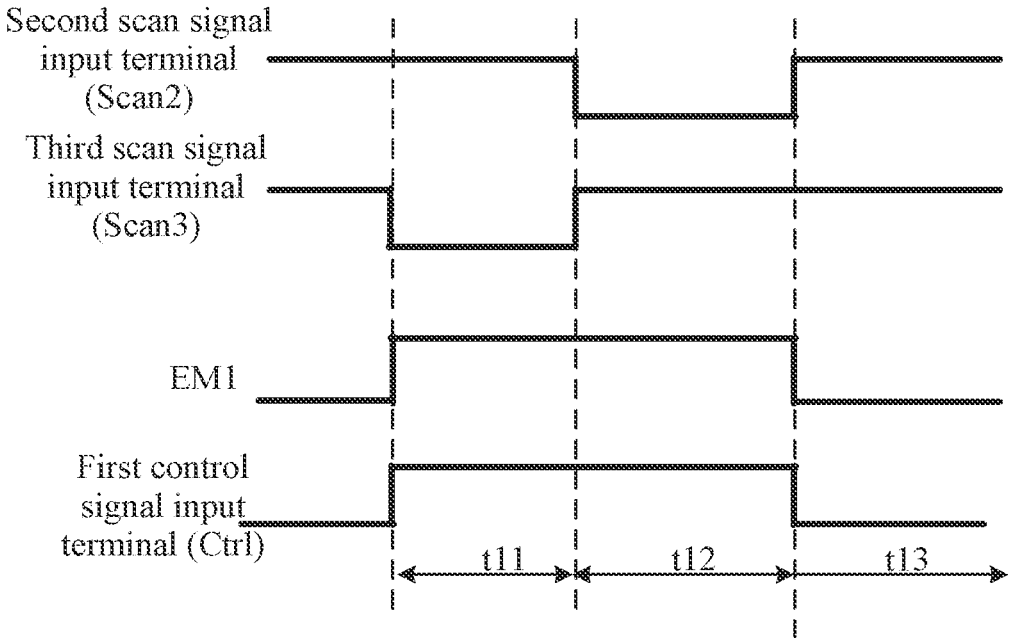

FIG. 12 is an operational timing diagram of the pixel circuit of FIG. 11 according to an embodiment of the present application.

Figure 13:
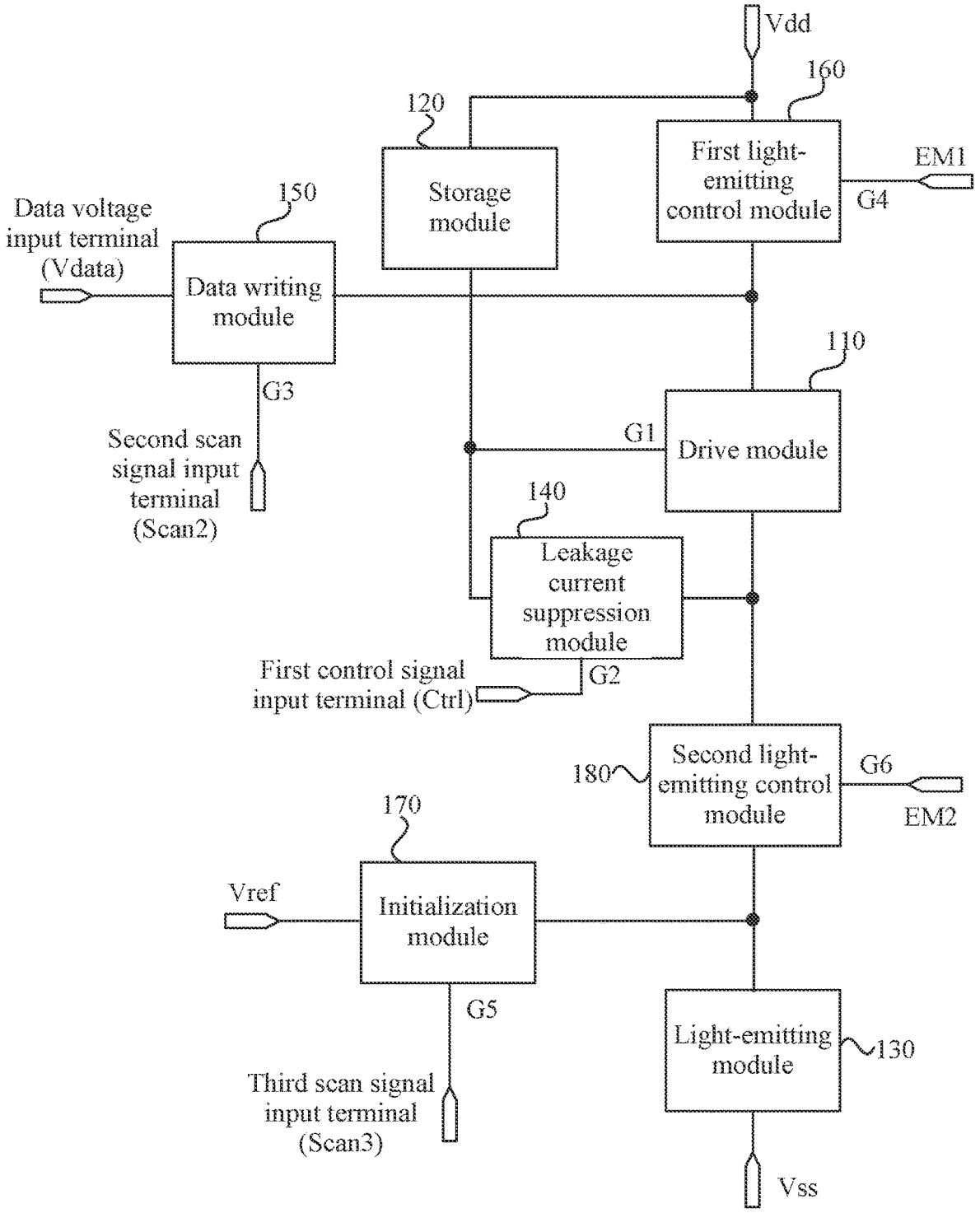

FIG. 13 is a structure diagram of another pixel circuit according to an embodiment of the present application, where FIG. 13 shows that the pixel circuit of FIG. 10 further includes a second light-emitting control module.

Figure 14:
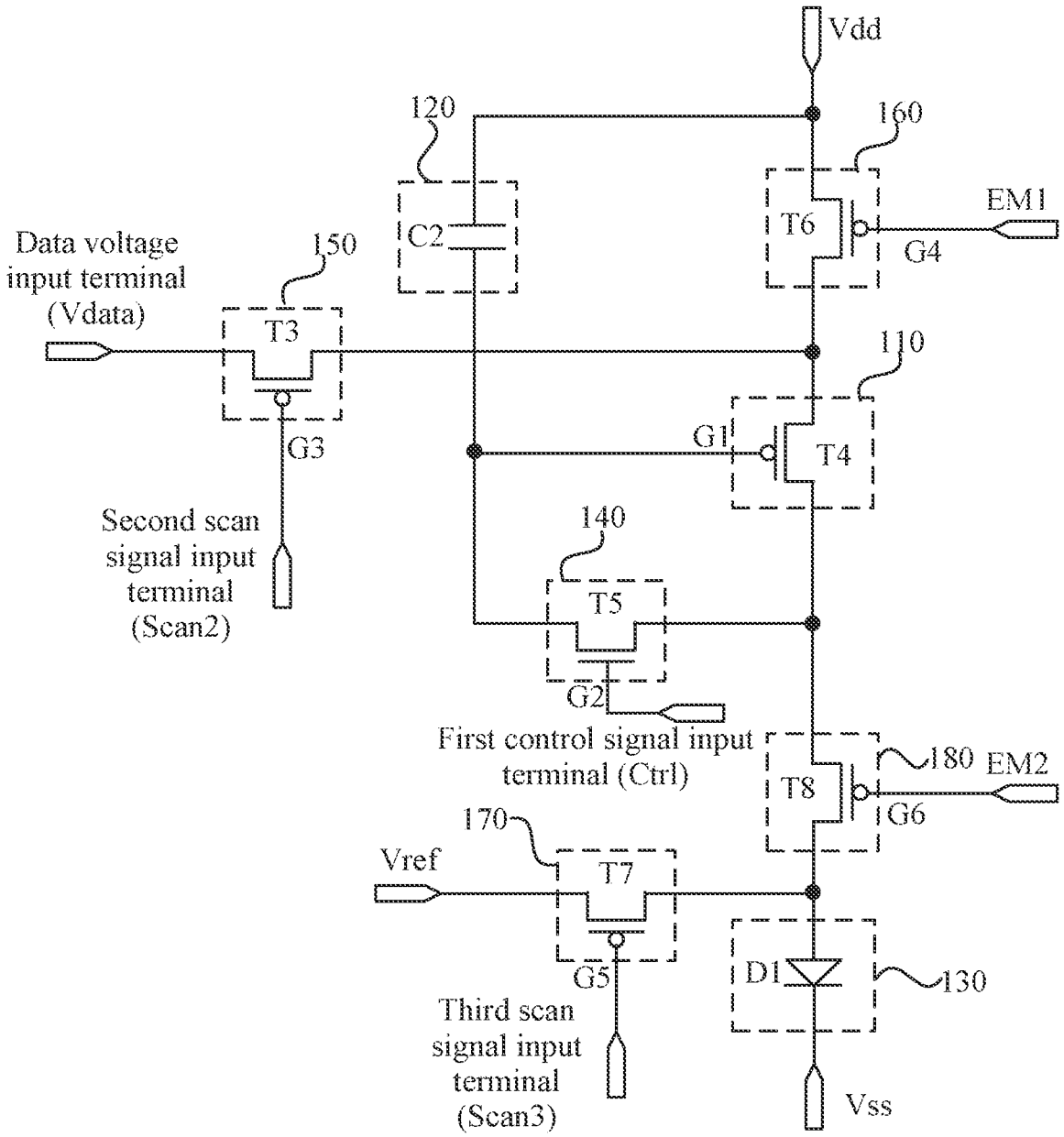

FIG. 14 is a structure diagram of another pixel circuit according to an embodiment of the present application, where FIG. 14 shows the second light-emitting control module of the pixel circuit of FIG. 10 includes an eighth transistor T8.

Figure 15:
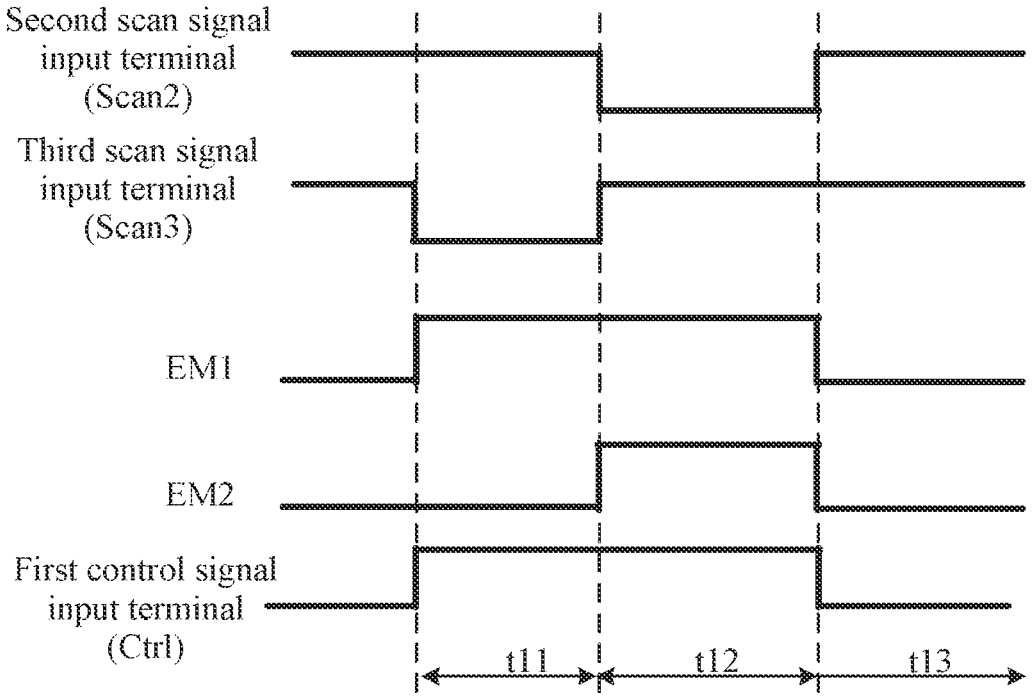

FIG. 15 is an operational timing diagram of the pixel circuit of FIG. 14 according to an embodiment of the present application.

Figure 16:
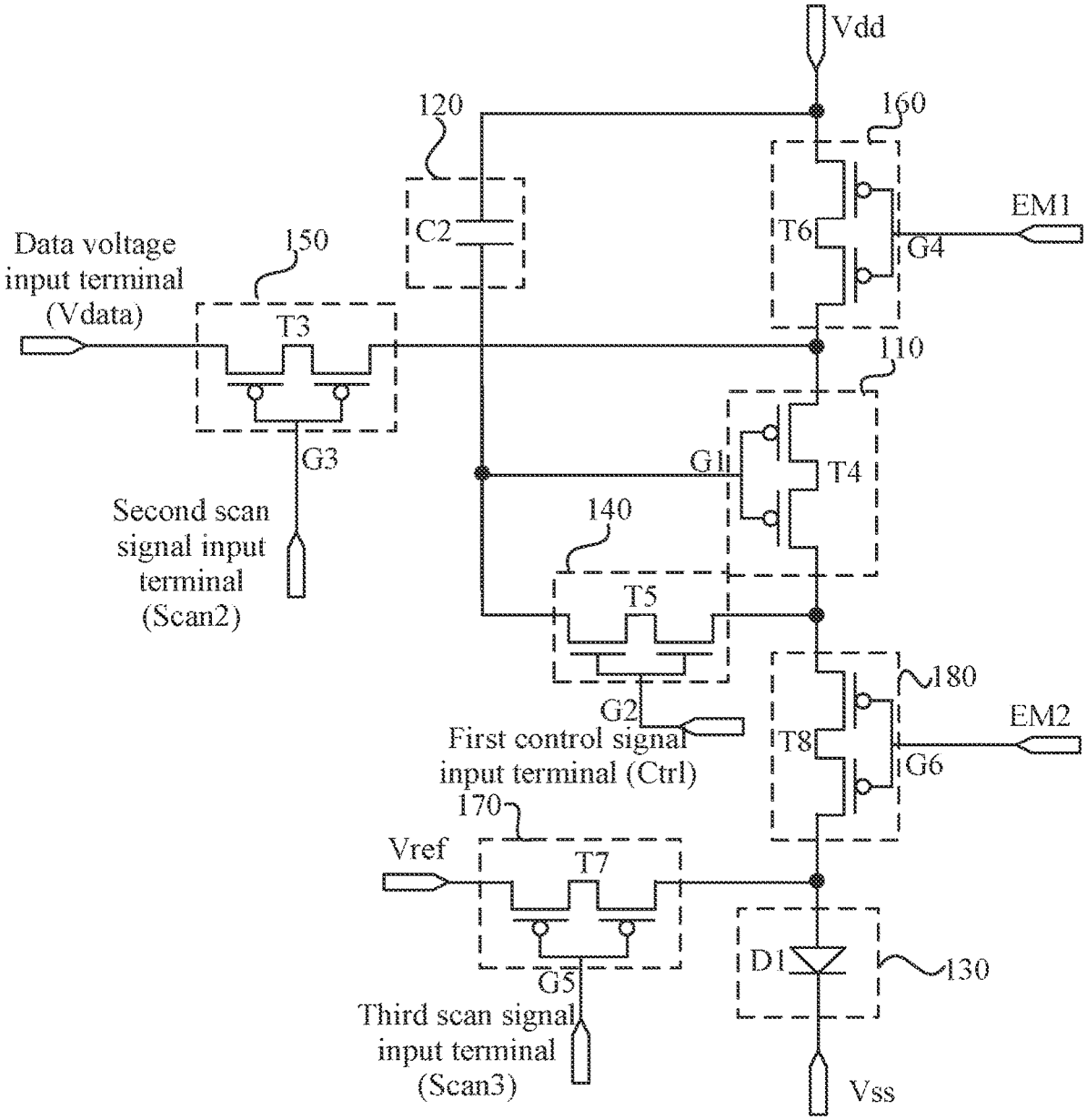

FIG. 16 is a structure diagram of another pixel circuit according to an embodiment of the present application, where FIG. 16 shows the third transistor T3, the fourth transistor T4, the fifth transistor T5, the sixth transistor T6, the seventh transistor T7 and the eighth transistor T8 are all dual-gate transistors based on the pixel circuit of FIG. 14.

Figure 17:
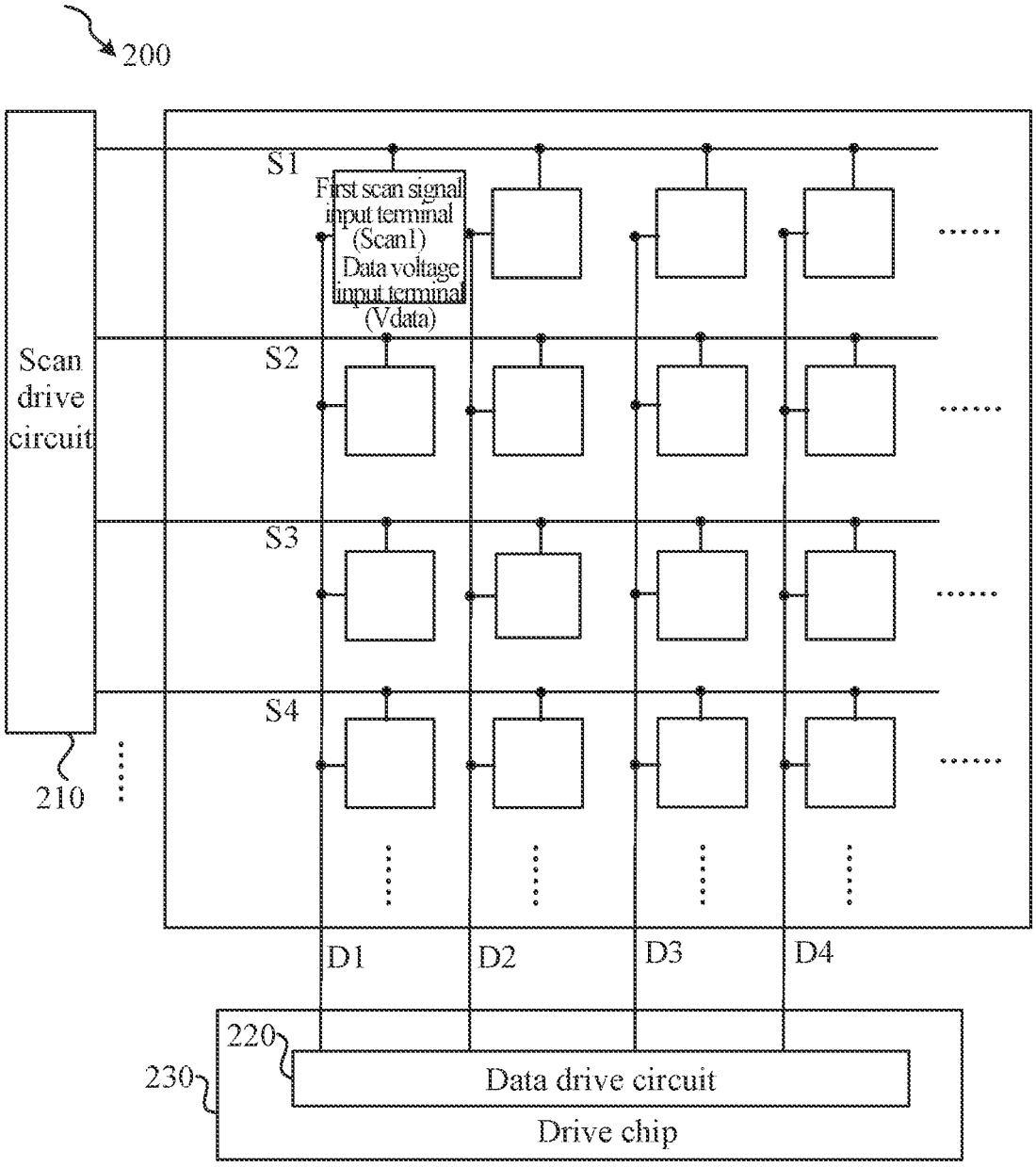

FIG. 17 is a structure diagram of a display device according to an embodiment of the present application.

DETAILED DESCRIPTION

The present application will be described below in conjunction with drawings and embodiments. The embodiments described below are intended to explain but not to limit the present application. For ease of description, only part, not all, of structures related to the present application are illustrated in the drawings.

In the pixel circuit, if a thin-film transistor electrically connected to a drive transistor has a relatively large leakage current, the gate potential of the drive transistor is unstable and the power consumption of the display device is relatively large. The reason for the preceding problem is as follows. The transistor electrically connected to the gate of the drive transistor is usually a low-temperature polysilicon transistor. The thin-film transistor formed by the low-temperature polysilicon process has a relatively large lattice gap and relatively high electron mobility. Therefore, the low-temperature polysilicon transistor has a relatively large leakage current. In this manner, in the case where the drive transistor is driving a light-emitting device to emit light, the gate potential can be gradually discharged through the low-temperature polysilicon transistor electrically connected to the drive transistor, so that the gate potential of the drive transistor cannot maintain stable in the light-emitting phase and the display effect is of relatively poor quality. In order to ensure the display effect, it is required to increase the drive frequency of the pixel circuit. In this manner, the power consumption of the drive chip is greatly increased and the power consumption of the entire display device is relatively large.

Figure 1:
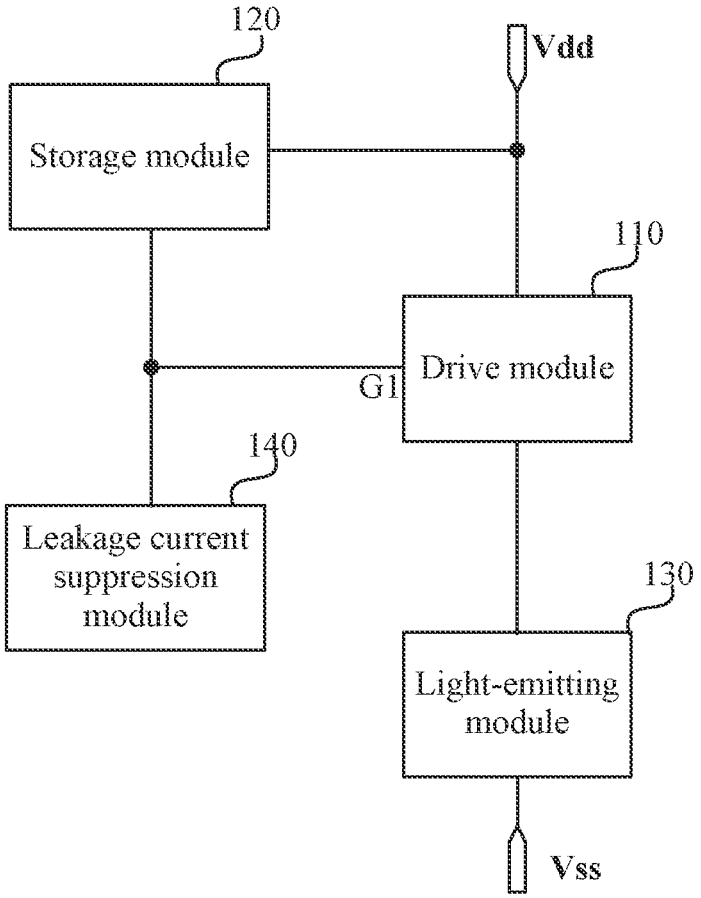
FIG. 1 is a structure diagram of a pixel circuit according to an embodiment of the present application.

Based on the preceding problem, embodiments of the present application provide a pixel circuit. FIG. 1 is a structure diagram of a pixel circuit according to an embodiment of the present application. This pixel circuit includes a drive module (also referred to as a drive circuit) 110, a storage module (also referred to as a storage circuit) 120, a light-emitting module (may be an organic light-emitting device) 130 and a leakage current suppression module (also referred to as a leakage current suppression circuit) 140.

In an embodiment, the drive module 110 is configured to drive the light-emitting module 130 to emit light according to the voltage of the control terminal G1 of the drive module 110.

The storage module 120 is configured to store the voltage of the control terminal G1 of the drive module 110.

The leakage current suppression module 140 is electrically connected to the control terminal G1 of the drive module 110 and is configured to maintain the potential of the control terminal G1 of the drive module 110.

In an embodiment, in the case where the pixel circuit is working, the operational timing of the pixel circuit usually includes at least a data writing phase and a light-emitting phase. In the data writing phase, a data voltage is written to the control terminal G1 of the drive module 110 and a terminal of the storage module 120. In the light-emitting phase, the drive module 110 controls the light-emitting module 130 to emit light according to the potential of the control terminal G1 of the drive module 110. In addition, in the light-emitting phase, the storage module 120 stores and maintains the potential of the control terminal G1 of the drive module 110. In the pixel circuit provided in embodiments of the present application, the leakage current suppression module 140 electrically connected to the control terminal G1 of the drive module 110 may have a relatively small leakage current, so that the potential of the control terminal G1 of the drive module 110 cannot be easily discharged, and the potential of the control terminal G1 of the drive module 110 can be maintained. Thus, the drive frequency of the pixel circuit can be reduced, the power consumption of the drive chip can be reduced, and the power consumption of the entire display device including this pixel circuit can be reduced. For a small and medium-sized display device, the power consumption of the drive chip accounts for about half of the power consumption of the entire display device. Therefore, for the small and medium-sized display device, the power consumption of the entire display device can be significantly reduced. In addition, since the leakage current suppression module 140 can make the potential of the control terminal G1 of the drive module 110 not easily discharged, the area of the storage module 120 can be reduced, which is beneficial to increase the pixel density.

Optionally, the leakage current suppression module 140 is an oxide transistor. The leakage current of the oxide transistor in an off state is significantly less than the leakage current of the low-temperature polysilicon thin-film transistor in the off state. Therefore, in the light-emitting phase, the potential of the control terminal G1 of the drive module 110 cannot be easily discharged through the leakage current suppression module 140. In this manner, the potential of the control terminal of the drive module 110 can maintain stable, which is beneficial to improve the display effect. In addition, the potential of the control terminal G1 of the drive module 110 maintains stable so that the drive frequency of the pixel circuit (such as the scan frequency and the frequency of writing a data voltage to the control terminal of the drive module) can be reduced. Thus, the power consumption of the drive chip can be reduced and the power consumption of the entire display device including this pixel circuit can be reduced. In addition, the conduction uniformity of the oxide transistor is good, and the threshold voltages of the oxide transistors in multiple pixel circuits are relatively uniform, so that the brightness of multiple light-emitting modules 130 during display can be more uniform and the display effect can be improved. The oxide transistor may be, for example, an indium gallium zinc oxide (IGZO) transistor.

In the pixel circuit provided in embodiments of the present application, the module electrically connected to the control terminal of the drive module is a leakage current suppression module. In this manner, the potential of the control terminal of the drive module cannot be easily discharged, the potential of the control terminal of the drive module can be maintained relatively well, and the display effect can be improved. In addition, the drive frequency of the pixel circuit can be reduced, and thus the power consumption of the drive chip in the display device including this pixel circuit can be reduced and the power consumption of the entire display device including this pixel circuit can be reduced. Furthermore, since the leakage current suppression module can make the potential of the control terminal of the drive module not easily discharged, the area of the storage module can be reduced, which is beneficial to increase the pixel density.

FIG. 2 is a structure diagram of another pixel circuit according to an embodiment of the present application. Referring to FIG. 2, optionally, the leakage current suppression module 140 includes a control terminal G2, a first terminal and a second terminal. The control terminal G2 of the leakage current suppression module 140 is configured to input a control signal to turn on or off the leakage current suppression module 140. The leakage current suppression module 140 is further configured to write a data voltage to the control terminal G1 of the drive module 110.

The control terminal G2 of the leakage current suppression module 140 is electrically connected to the first scan signal input terminal Scan1 of the pixel circuit. The first terminal of the leakage current suppression module 140 is electrically connected to the data voltage input terminal Vdata of the pixel circuit. The second terminal of the leakage current suppression module 140 is electrically connected to the control terminal G1 of the drive module.

The first terminal of the drive module 110 is electrically connected to the first voltage signal input terminal Vdd of the pixel circuit. The second terminal of the drive module 110 is electrically connected to the first terminal of the light-emitting module 130. The second terminal of the light-emitting module 130 is electrically connected to the second voltage signal input terminal Vss of the pixel circuit.

Two terminals of the storage module 120 are electrically connected to the control terminal G1 of the drive module 110 and the first terminal of the drive module 110, respectively.

Referring to FIG. 2, the leakage current suppression module 140 is configured to control the writing of the data voltage. This leakage current suppression module 140 may be an oxide transistor, for example, an IGZO thin-film transistor. The operational timing of this pixel circuit may be divided into a data writing phase and a light-emitting phase. In the data writing phase, the leakage current suppression module 140 is turned on, and the data voltage is written to the control terminal G1 of the drive module 110 through the turned-on leakage current suppression module 140. In the light-emitting phase, the leakage current suppression module 140 is turned off. Since the leakage current suppression module 140 has a relatively low leakage current in the off state, it can be ensured that the potential of the control terminal G1 of the drive module 110 can maintain stable, and in the display device including the pixel circuit provided in this embodiment, both the scan frequency of the scan drive circuit and the frequency of the output data voltage of the data drive circuit can be reduced. In addition, the control signals of the scan drive circuit and the data drive circuit are usually provided by the drive chip so that the drive frequency of the drive chip can be reduced and the power consumption of the display device including this pixel circuit can be reduced.

FIG. 3 is a structure diagram of another pixel circuit according to an embodiment of the present application. Referring to FIG. 3, optionally, the leakage current suppression module 140 includes a first transistor T1. The drive module 110 includes a second transistor T2. The storage module 120 includes a first capacitor C1. The light-emitting module 130 includes an organic light-emitting diode DE The second transistor T2 is a low-temperature polysilicon transistor.

The gate of the first transistor T1 serves as the control terminal G2 of the leakage current suppression module 140. The first electrode of the first transistor T1 serves as the first terminal of the leakage current suppression module 140. The second electrode of the first transistor T1 serves as the second terminal of the leakage current suppression module 140.

The gate of the second transistor T2 serves as the control terminal G1 of the drive module 110. The first electrode of the second transistor T2 serves as the first terminal of the drive module 110. The second electrode of the second transistor T2 serves as the second terminal of the drive module 110.

Two electrode plates of the first capacitor C1 serve as two terminals of the storage module 120, respectively.

The anode and the cathode of the organic light-emitting diode D1 serve as the first terminal and the second terminal of the light-emitting module 130, respectively.

In an embodiment, the first electrode of the transistor may be a source or a drain. In the case where the first electrode is a source, the second electrode is a drain. In the case where the first electrode is a drain, the second electrode is a source.

FIG. 4 is an operational timing diagram of a pixel circuit according to an embodiment of the present application. This operational timing diagram may correspond to the pixel circuit in FIG. 3. Referring to FIG. 3, the case where the first transistor T1 is an N-type transistor and the second transistor T2 is a P-type transistor is used as an example for description. Referring to FIG. 4, the operational timing of the pixel circuit shown in FIG. 3 may be divided into a data writing phase t1 and a light-emitting phase t2.

Referring to FIG. 3 and FIG. 4, in the data writing phase t1, the first scan signal input terminal Scan1 inputs a high-level signal, the first transistor T1 is turned on, and the data voltage is written to the gate of the second transistor T2 through the turned-on first transistor T1.

In the light-emitting phase t2, the first scan signal input terminal Scan1 inputs a low-level signal, the first transistor T1 is turned off, and the second transistor T2 drives the organic light-emitting diode D1 to emit light according to the gate potential of the second transistor T2. The first transistor T1 may be an oxide transistor, for example, an IGZO transistor. Since the oxide transistor has a relatively low leakage current in the off state, it can be ensured that the gate potential of the second transistor T2 can maintain stable. Thus, the drive frequency of the drive chip in the display device including this pixel circuit can be reduced and the power consumption of the display device including this pixel circuit can be reduced. In addition, the gate potential of the second transistor T2 maintains stable so that the capacitance value of the first capacitor C1 does not need to be greatly large to maintain the gate potential of the second transistor T2. In this manner, the area of the first capacitor C1 can be reduced, which is beneficial to increase the pixel density. Furthermore, the pixel circuit provided in this embodiment includes only two thin-film transistors so that the layout space of the pixel circuit is relatively small, which is more beneficial to improve the pixel density.

FIG. 5 is a structure diagram of another pixel circuit according to an embodiment of the present application. Referring to FIG. 5, optionally, the pixel circuit further includes a data writing module (also referred to as a data writing circuit) 150 and a first light-emitting control module (also referred to as a first light-emitting control circuit) 160. The leakage current suppression module 140 includes a control terminal G2, a first terminal and a second terminal. The control terminal G2 of the leakage current suppression module 140 is configured to input a control signal to turn on or off the leakage current suppression module 140.

The control terminal G3 of the data writing module 150 is electrically connected to the second scan signal input terminal Scan2 of the pixel circuit. The first terminal of the data writing module 150 is electrically connected to the data voltage input terminal Vdata of the pixel circuit. The second terminal of the data writing module 150 is electrically connected to the first terminal of the drive module 110.

The first terminal of the first light-emitting control module 160 is electrically connected to the first voltage signal input terminal Vdd of the pixel circuit. The second terminal of the first light-emitting control module 160 is electrically connected to the first terminal of the drive module 110. The control terminal G4 of the first light-emitting control module 160 is electrically connected to the first light-emitting control signal input terminal EM1 of the pixel circuit.

The control terminal G1 of the drive module 110 is electrically connected to the second terminal of the leakage current suppression module 140. The second terminal of the drive module 110 is electrically connected to the first terminal of the leakage current suppression module 140 and is further electrically connected to the first terminal of the light-emitting module 130.

The second terminal of the light-emitting module 130 is electrically connected to the second voltage signal input terminal Vss of the pixel circuit.

Referring to FIG. 5, the control terminal G2 of the leakage current suppression module 140 may be electrically connected to the first control signal input terminal Ctrl of the pixel circuit. In the case where this pixel circuit is working, the operational timing of this pixel circuit may include a data writing phase and a light-emitting phase. In the data writing phase, the data writing module 150 and the leakage current suppression module 140 are controlled to be turned on, the first light-emitting control module 160 is controlled to be turned off, and the data voltage is written to the control terminal G1 of the drive module 110 through the data writing module 150, the drive module 110 and the leakage current suppression module 140 which are turned on.

In the light-emitting phase, the data writing module 150 and the leakage current suppression module 140 are controlled to be turned off, and the first light-emitting control module 160 is turned on. Since the leakage current suppression module 140 has a relatively low leakage current in the off state, it can be ensured that the potential of the control terminal of the drive module 110 can maintain stable, and thus the display effect can be improved. In addition, the drive frequency of the drive chip in the display device including the pixel circuit provided in this embodiment can be reduced, and the power consumption of the display device including this pixel circuit can be reduced.

FIG. 6 is a structure diagram of another pixel circuit according to an embodiment of the present application. Referring to FIG. 6, optionally, the data writing module 150 includes a third transistor T3, the drive module 110 includes a fourth transistor T4, the leakage current suppression module 140 includes a fifth transistor T5, the first light-emitting control module 160 includes a sixth transistor T6, the storage module 120 includes a second capacitor C2, and the light-emitting module 130 includes an organic light-emitting diode D1. The third transistor T3, the fourth transistor T4 and the sixth transistor T6 are all low-temperature polysilicon transistors.

The gate of the third transistor T3 serves as the control terminal G3 of the data writing module 150. The first electrode of the third transistor T3 serves as the first terminal of the data writing module 150. The second electrode of the third transistor T3 serves as the second terminal of the data writing module 150.

The gate of the fourth transistor T4 serves as the control terminal G1 of the drive module 110. The first electrode of the fourth transistor T4 serves as the first terminal of the drive module 110. The second electrode of the fourth transistor T4 serves as the second terminal of the drive module 110.

The gate of the fifth transistor T5 serves as the control terminal G2 of the leakage current suppression module 140. The first electrode of the fifth transistor T5 serves as the first terminal of the leakage current suppression module 140. The second electrode of the fifth transistor T5 serves as the second terminal of the leakage current suppression module 140.

The gate of the sixth transistor T6 serves as the control terminal G4 of the first light-emitting control module 160. The first electrode of the sixth transistor T6 serves as the first terminal of the first light-emitting control module 160. The second electrode of the sixth transistor T6 serves as the second terminal of the first light-emitting control module 160.

Two electrode plates of the second capacitor C2 serve as two terminals of the storage module 120, respectively.

The anode and the cathode of the organic light-emitting diode D1 serve as the first terminal and the second terminal of the light-emitting module 130, respectively.

FIG. 7 is an operational timing diagram of another pixel circuit according to an embodiment of the present application. This operational timing diagram may correspond to the pixel circuit shown in FIG. 6. Referring to FIG. 6 and FIG. 7, the operational timing of the pixel circuit shown in FIG. 6 includes a data writing phase and a light-emitting phase. The fifth transistor T5 may be an oxide transistor or an IGZO transistor. FIG. 6 schematically illustrates the case where the fifth transistor T5 is an N-type transistor and the other transistors are P-type transistors.

Referring to FIG. 6 and FIG. 7, in the data writing phase t1, the second scan signal input terminal Scan2 inputs a low level, and the third transistor T3 is turned on; the first control signal input terminal Ctrl inputs a high level, and the fifth transistor T5 is turned on; the first light-emitting control signal input terminal EM1 inputs a high level, and the sixth transistor T6 is turned off; and the data voltage is written to the gate of the fourth transistor T4 through the third transistor T3, the fourth transistor T4 and the fifth transistor T5 which are turned on. In the case where the gate potential of the fourth transistor T4 reaches VDD−|Vth| (VDD is the voltage input from the first voltage signal input terminal Vdd, and Vth is the threshold voltage of the fourth transistor T4), the fourth transistor T4 is turned off, and the writing of the gate potential of the fourth transistor T4 and the compensation of the threshold voltage of the fourth transistor T4 are completed, so that the display cannot be affected by the threshold voltage of the fourth transistor, which is beneficial to improve the display uniformity and the display effect.

In the light-emitting phase t2, the second scan signal input terminal Scan2 inputs a high level, and the third transistor T3 is turned off; the first control signal input terminal Ctrl inputs a low level, and the fifth transistor T5 is turned off; the first light-emitting control signal input terminal EM1 inputs a low level, and the sixth transistor T6 is turned on; and the fourth transistor T4 drives the organic light-emitting diode D1 to emit light. The fifth transistor T5 may be an oxide transistor, for example, an IGZO transistor. Since the oxide transistor has a relatively low leakage current in the off state, it can be ensured that the gate potential of the fourth transistor T4 can maintain stable, and thus the drive frequency of this pixel circuit can be reduced and the power consumption of the display device including this pixel circuit can be reduced. In addition, since the oxide transistor has a relatively low leakage current in the off state, it can be ensured that the gate potential of the fourth transistor T4 can maintain stable so that the capacitance value of the second capacitor C2 does not need to be greatly large to maintain the gate potential of the fourth transistor T4. In this manner, the area of the second capacitor C2 can be reduced, which is beneficial to increase the pixel density.

FIG. 8 is a structure diagram of another pixel circuit according to an embodiment of the present application. Referring to FIG. 8, based on the preceding solution, optionally, the channel type of the fifth transistor T5 is different from the channel type of the sixth transistor T6, and the gate of the fifth transistor T5 is electrically connected to the first light-emitting control signal input terminal EM1 of the pixel circuit.

The fifth transistor T5 and the sixth transistor T6 have different on-off states in multiple working stages of the pixel circuit. Therefore, the channel type of the fifth transistor T5 is different from the channel type of the sixth transistor T6. In this manner, the fifth transistor T5 and the sixth transistor T6 can be controlled by using one control line, which is beneficial to reduce the wiring of the display device including this pixel circuit and achieve the narrow frame of the display device. Optionally, due to the process limitation of the oxide transistor, the fifth transistor T5 is an N-type transistor.

FIG. 9 is an operational timing diagram of another pixel circuit according to an embodiment of the present application. This operational timing diagram may correspond to the pixel circuit shown in FIG. 8. Referring to FIG. 8 and FIG. 9, the operational timing of the pixel circuit shown in FIG. 8 includes a data writing phase and a light-emitting phase. The fifth transistor T5 may be an oxide transistor, for example, an IGZO transistor. FIG. 8 schematically illustrates the case where the fifth transistor T5 is an N-type transistor and the other transistors are P-type transistors.

Referring to FIG. 8 and FIG. 9, in the data writing phase t1, the second scan signal input terminal Scan2 inputs a low level, and the third transistor T3 is turned on; the first light-emitting control signal input terminal EM1 inputs a high level, the fifth transistor T5 is turned on, and the sixth transistor T6 is turned off; and the data voltage is written to the gate of the fourth transistor T4 through the third transistor T3, the fourth transistor T4 and the fifth transistor T5 which are turned on. In the case where the gate potential of the fourth transistor T4 reaches VDD (VDD is the voltage input from the first voltage signal input terminal Vdd, and Vth is the threshold voltage of the fourth transistor T4), the fourth transistor T4 is turned off, and the writing of the gate potential of the fourth transistor T4 and the compensation of the threshold voltage of the fourth transistor T4 are completed.

In the light-emitting phase t2, the second scan signal input terminal Scan2 inputs a high level, and the third transistor T3 is turned off; the first light-emitting control signal input terminal EM1 inputs a low level, the fifth transistor T5 is turned off, and the sixth transistor T6 is turned on; and the fourth transistor T4 drives the organic light-emitting diode D1 to emit light. The fifth transistor T5 may be an oxide transistor, for example, an IGZO transistor. Since the oxide transistor has a relatively low leakage current in the off state, it can be ensured that the gate potential of the fourth transistor T4 can maintain stable, and thus the drive frequency of this pixel circuit can be reduced and the power consumption of the display device including this pixel circuit can be reduced. In addition, since the oxide transistor has a relatively low leakage current in the off state, it can be ensured that the gate potential of the fourth transistor T4 can maintain stable so that the capacitance value of the second capacitor C2 does not need to be greatly large to maintain the gate potential of the fourth transistor T4. In this manner, the area of the second capacitor C2 can be reduced, which is beneficial to increase the pixel density.

FIG. 10 is a structure diagram of another pixel circuit according to an embodiment of the present application. Referring to FIG. 10, based on the preceding solution, optionally, this pixel circuit further includes an initialization module (also referred to as an initialization circuit) 170. The initialization module 170 includes a control terminal G5, a first terminal and a second terminal. The control terminal G5 of the initialization module 170 is electrically connected to the third scan signal input terminal Scan3 of the pixel circuit. The first terminal of the initialization module 170 is electrically connected to the initialization voltage input terminal Vref of the pixel circuit. The second terminal of the initialization module 170 is electrically connected to the first terminal of the light-emitting module 130.

Referring to FIG. 10, in the case where this pixel circuit is working, the operational timing of this pixel circuit may include an initialization phase, a data writing phase and a light-emitting phase.

In the initialization phase, the initialization module 170 is turned on, the first light-emitting control module 160, the data writing module 150 and the leakage current suppression module 140 are turned off, and the potential of the first terminal of the light-emitting module 130 is initialized to Vref.

In the data writing phase, the initialization module 170 is turned off, the data writing module 150 and the leakage current suppression module 140 are turned on, the first light-emitting control module 160 is turned off, and the data voltage is written to the control terminal G1 of the drive module 110 through the data writing module 150, the drive module 110 and the leakage current suppression module 140 which are turned on.

In the light-emitting phase, the initialization module 170, the data writing module 150 and the leakage current suppression module 140 are turned off, and the first light-emitting control module 160 is turned on. Since the leakage current suppression module 140 has a relatively low leakage current in the off state, it can be ensured that the potential of the control terminal G1 of the drive module 110 can maintain stable, and thus the drive frequency of this pixel circuit can be reduced and the power consumption of the display device including this pixel circuit can be reduced.

The pixel circuit provided in this embodiment includes an initialization module. The initialization module can initialize the potential of the first terminal of the light-emitting module and the potential of the control terminal of the drive module so that the potential of the control terminal of the drive module and the potential of the first terminal of the light-emitting module are discharged in the initialization phase. In this manner, the impact of residual charges, which are generated during driving of the previous frame, at the control terminal of the drive module and the first terminal of the light-emitting module on the display image of this frame can be avoided, which is beneficial to improve the display effect.

FIG. 11 is a structure diagram of another pixel circuit according to an embodiment of the present application. Referring to FIG. 11, optionally, the initialization module 170 includes a seventh transistor T7, the gate of the seventh transistor T7 serves as the control terminal G5 of the initialization module 170, the first electrode of the seventh transistor T7 serves as the first terminal of the initialization module 170, and the second electrode of the seventh transistor T7 serves as the second terminal of the initialization module 170.

FIG. 12 is an operational timing diagram of another pixel circuit according to an embodiment of the present application. This operational timing diagram may correspond to the pixel circuit shown in FIG. 11. Referring to FIG. 11 and FIG. 12, the operational timing of the pixel circuit shown in FIG. 11 includes an initialization phase t11, a data writing phase t12 and a light-emitting phase t13. FIG. 11 schematically illustrates the case where the fifth transistor T5 is an N-type transistor and the other transistors are P-type transistors.

Referring to FIG. 11 and FIG. 12, in the initialization phase t11, the second scan signal input terminal Scan2 inputs a high level, and the third transistor T3 is turned off; the third scan signal input terminal Scan3 inputs a low level, and the seventh transistor T7 is turned on; the first control signal input terminal Ctrl inputs a high level, and the fifth transistor T5 is turned on; the first light-emitting control signal input terminal EM1 inputs a high level, and the sixth transistor T6 is turned off; the initialization voltage input from the initialization voltage input terminal Vref is written to the anode of the organic light-emitting diode D1 through the turned-on seventh transistor T7; and the initialization voltage input from the initialization voltage input terminal Vref is written to the gate of the fourth transistor T4 through the turned-on seventh transistor T7 and the fifth transistor T5.

In the data writing phase t12, the second scan signal input terminal Scan2 inputs a low level, and the third transistor T3 is turned on; the third scan signal input terminal Scan3 inputs a high level, and the seventh transistor T7 is turned off; the first control signal input terminal Ctrl inputs a high level, and the fifth transistor T5 is turned on; the first light-emitting control signal input terminal EM1 inputs a high level, and the sixth transistor T6 is turned off; and the data voltage is written to the gate of the fourth transistor T4 through the third transistor T3, the fourth transistor T4 and the fifth transistor T5 which are turned on, and the writing of the gate potential of the fourth transistor T4 and the compensation of the threshold voltage of the fourth transistor T4 are completed.

In the light-emitting phase t13, the second scan signal input terminal Scan2 inputs a high level, and the third transistor T3 is turned off; the third scan signal input terminal Scan3 inputs a high level, and the seventh transistor T7 is turned off; the first control signal input terminal Ctrl inputs a low level, and the fifth transistor T5 is turned off; the first light-emitting control signal input terminal EM1 inputs a low level, and the sixth transistor T6 is turned on; and the fourth transistor T4 drives the organic light-emitting diode D1 to emit light. The fifth transistor T5 may be an oxide transistor, for example, an IGZO transistor. Since the oxide transistor has a relatively low leakage current in the off state, it can be ensured that the gate potential of the fourth transistor T4 can maintain stable, and thus the drive frequency of the drive chip driving this pixel circuit in the display device including this pixel circuit can be reduced and the power consumption of the display device including this pixel circuit can be reduced. With continued reference to FIG. 11 and FIG. 12, optionally, the channel type of the fifth transistor is different from the channel type of the sixth transistor. For example, in the case where the fifth transistor T5 is an N-type transistor and the sixth transistor T6 is a P-type transistor, the first control signal input terminal Ctrl electrically connected to the gate of the fifth transistor T5 and the first light-emitting control signal input terminal EM1 electrically connected to the gate of the sixth transistor T6 have the same timing in multiple working stages of the pixel circuit. Therefore, in this case, the pixel circuit may not be provided with the first control signal input terminal Ctrl, and the gate of the fifth transistor T5 is connected to the first light-emitting control signal input terminal EM1. In this manner, the fifth transistor T5 and the sixth transistor T6 can be controlled by using one control line, which is beneficial to reduce the wiring of the display device including this pixel circuit and achieve the narrow frame of the display device.

The pixel circuit provided in this embodiment includes a seventh transistor. The initialization voltage input terminal can initialize the anode potential of the organic light-emitting diode and the gate potential of the fourth transistor through the seventh transistor so that the gate potential of the fourth transistor and the anode potential of the organic light-emitting diode are discharged in the initialization phase. In this manner, the impact of residual charges, which are generated during the previous frame driving, at the gate of the fourth transistor and the anode of the organic light-emitting diode on the display image of this frame can be avoided, which is beneficial to improve the display effect.

FIG. 13 is a structure diagram of another pixel circuit according to an embodiment of the present application. Referring to FIG. 13, optionally, this pixel circuit further includes a second light-emitting control module (also referred to as a second light-emitting control circuit) 180, the first terminal of the second light-emitting control module 180 is electrically connected to the second terminal of the drive module 110, the second terminal of the second light-emitting control module 180 is electrically connected to the first terminal of the light-emitting module 130, and the control terminal G6 of the second light-emitting control module 180 is electrically connected to the second light-emitting control signal input terminal EM2 of the pixel circuit. In the case where this pixel circuit is working, the operational timing of this pixel circuit may include an initialization phase, a data writing phase and a light-emitting phase.

In the initialization phase, the initialization module 170 is turned on, the first light-emitting control module 160, the second light-emitting control module 180, the data writing module 150 and the leakage current suppression module 140 are turned off, and the potential of the first terminal of the light-emitting module 130 is initialized to Vref.

In the data writing phase, the initialization module 170 is turned off, the data voltage writing module and the leakage current suppression module 140 are turned on, the first light-emitting control module 160 and the second light-emitting control module 180 are turned off, and the data voltage is written to the control terminal G1 of the drive module 110 through the data writing module 150, the drive module 110 and the leakage current suppression module 140 which are turned on.

In the light-emitting phase, the initialization module 170, the data writing module 150 and the leakage current suppression module 140 are turned off, and the first light-emitting control module 160 and the second light-emitting control module 180 are turned on. Since the leakage current suppression module 140 has a relatively low leakage current in the off state, it can be ensured that the potential of the control terminal G1 of the drive module 110 can maintain stable, and thus the drive frequency of the drive chip can be reduced and the power consumption of the display device including this pixel circuit can be reduced. In addition, the on-off states of the first light-emitting control module 160 and the second light-emitting control module 180 are always the same. Therefore, the control terminal G6 of the second light-emitting control module 180 and the control terminal G4 of the first light-emitting control module 160 may also be electrically connected to a same light-emitting control signal input terminal, and thus the number of light-emitting control signal lines can be reduced, which is beneficial to achieve the narrow frame.

In an embodiment, in the initialization phase, the second light-emitting control module 180 and the leakage current suppression module 140 may also be controlled to be turned on so that the initialization voltage input from the initialization voltage input terminal Vref is written to the control terminal G1 of the drive module 110 through the turned-on initialization module 170, the second light-emitting control module 180 and the leakage current suppression module 140. In this manner, the potential of the control terminal of the drive module 110 can be initialized, and thus it is easier to write the data voltage in the data writing phase. In the initialization phase, the first light-emitting control module 160 and the data writing module 150 are still turned off. In this case, the control terminal of the first light-emitting control module 160 and the control terminal of the second light-emitting control module 180 are electrically connected to different light-emitting control signal input terminals.

FIG. 14 is a structure diagram of another pixel circuit according to an embodiment of the present application. Referring to FIG. 14, optionally, the second light-emitting control module 180 includes an eighth transistor T8, the first electrode of the eighth transistor T8 is electrically connected to the second electrode of the fourth transistor T4, the second electrode of the eighth transistor T8 is electrically connected to the anode of the organic light-emitting diode D1, and the gate of the eighth transistor T8 is electrically connected to the second light-emitting control signal input terminal EM2 of the pixel circuit.

FIG. 15 is an operational timing diagram of another pixel circuit according to an embodiment of the present application. This operational timing diagram may correspond to the pixel circuit shown in FIG. 14. Referring to FIG. 14 and FIG. 15, the operational timing of the pixel circuit shown in FIG. 14 includes an initialization phase t11, a data writing phase t12 and a light-emitting phase t13. FIG. 14 schematically illustrates the case where the fifth transistor T5 is an N-type transistor and the other transistors are P-type transistors.

Referring to FIG. 14 and FIG. 15, in the initialization phase t11, the second scan signal input terminal Scan2 inputs a high level, and the third transistor T3 is turned off; the third scan signal input terminal Scan3 inputs a low level, and the seventh transistor T7 is turned on; the first light-emitting control signal input terminal EM1 inputs a high level, and the sixth transistor T6 is turned off; the first control signal input terminal Ctrl inputs a high level, and the fifth transistor T5 is turned on; the second light-emitting control signal input terminal EM2 inputs a low level, and the eighth transistor T8 is turned on; and the anode potential of the organic light-emitting diode D1 and the gate potential of the fourth transistor T4 are initialized to the potential of the initialization voltage input terminal Vref.

In the data writing phase t12, the second scan signal input terminal Scan2 inputs a low level, and the third transistor T3 is turned on; the third scan signal input terminal Scan3 inputs a high level, and the seventh transistor T7 is turned off; the first control signal input terminal Ctrl inputs a high level, and the fifth transistor T5 is turned on; the first light-emitting control signal input terminal EM1 inputs a high level, and the sixth transistor T6 is turned off; the second light-emitting control signal input terminal EM2 inputs a high level, and the eighth transistor T8 is turned off; and the data voltage is written to the gate of the fourth transistor T4 through the third transistor T3, the fourth transistor T4 and the fifth transistor T5 which are turned on, and the compensation of the threshold voltage of the fourth transistor T4 is completed.

In the light-emitting phase t13, the second scan signal input terminal Scan2 inputs a high level, and the third transistor T3 is turned off; the third scan signal input terminal Scan3 inputs a high level, and the seventh transistor T7 is turned off; the first control signal input terminal Ctrl inputs a low level, and the fifth transistor T5 is turned off; the first light-emitting control signal input terminal EM1 inputs a low level, and the sixth transistor T6 is turned on; the second light-emitting control signal input terminal EM2 inputs a low level, and the eighth transistor T8 is turned on; and the fourth transistor T4 drives the organic light-emitting diode D1 to emit light. The fifth transistor T5 may be an oxide transistor, for example, an IGZO transistor. Since the oxide transistor has a relatively low leakage current in the off state, it can be ensured that the gate potential of the fourth transistor T4 can maintain stable, the display effect can be improved, and thus the drive frequency of the drive chip driving this pixel circuit in the display device including this pixel circuit can be reduced and the power consumption of the display device including this pixel circuit can be reduced. With continued reference to FIG. 14 and FIG. 15, the control signal input from the gate of the fifth transistor T5 and the control signal input from the gate of the sixth transistor T6 are the same in multiple stages. Therefore, the gate of the fifth transistor T5 and the gate of the sixth transistor T6 may be electrically connected to the same control signal input terminal. For example, the gate of the fifth transistor T5 is also electrically connected to the first light-emitting control signal input terminal EM1. In this manner, the first control signal input terminal Ctrl in the pixel circuit may be not provided, and thus the corresponding control signal lines can be reduced, which is beneficial to achieve the narrow frame of the display device including this pixel circuit.

FIG. 16 is a structure diagram of another pixel circuit according to an embodiment of the present application. Referring to FIG. 16, based on the preceding solution, optionally, the third transistor T3, the fourth transistor T4, the fifth transistor T5, the sixth transistor T6, the seventh transistor T7 and the eighth transistor T8 are all dual-gate transistors.

The operational timing shown in FIG. 15 is also applicable to the pixel circuit shown in FIG. 16. In an embodiment, the leakage current of the dual-gate transistor is significantly less than the leakage current of the single-gate transistor. Therefore, each transistor in the pixel circuit is configured as a dual-gate transistor so that the leakage current in the pixel circuit can be reduced. In this manner, in the light-emitting phase, the gate potential of the fourth transistor T4 (a drive transistor) can be maintained and the display effect can be improved. In addition, the drive frequency of the pixel circuit can be reduced and the power consumption of the entire display device can be reduced.

In an embodiment, the transistor in any one of the preceding embodiments of the present application may be a dual-gate transistor, and thus the leakage current in the pixel circuit can be reduced.

Embodiments of the present application further provide a display device. FIG. 17 is a structure diagram of a display device according to an embodiment of the present application. Referring to FIG. 17, the display device includes the pixel circuit provided in any one of embodiments of the present application. The display device 200 further includes a scan drive circuit 210, a data drive circuit 220 and a drive chip 230. The data drive circuit 220 is integrated in the drive chip 230, as well as multiple data lines (D1, D2, D3 . . . ) and multiple scan lines (S1, S2, S3 . . . ). The ports of the scan drive circuit 210 are electrically connected to the scan lines, and the ports of the data drive circuit 220 are electrically connected to the data lines. The case where the display device includes the pixel circuit shown in FIG. 2 is used as an example. Referring to FIG. 2, the pixel circuit includes a data voltage input terminal Vdata and a first scan signal input terminal Scan1. The data voltage input terminal Vdata of each pixel circuit is connected to a respective one of data lines, and the first scan signal input terminal Scan1 of each pixel circuit is connected to a respective one of scan line. FIG. 17 schematically shows the data voltage input terminal Vdata and the first scan signal input terminal Scan1 of the pixel circuit corresponding to one pixel.

The display device provided in embodiments of the present application includes the pixel circuit provided in any one of embodiments of the present application. The module electrically connected to the control terminal of the drive module is a leakage current suppression module. In this manner, the potential of the control terminal of the drive module cannot be easily discharged, the potential of the control terminal of the drive module can be relatively well maintained, and the display effect can be improved. In addition, the drive frequency of the pixel circuit can be reduced, and thus the power consumption of the drive chip in the display device including this pixel circuit can be reduced and the power consumption of the entire display device including this pixel circuit can be reduced. Furthermore, since the leakage current suppression module can make the potential of the control terminal of the drive module not easily discharged, the area of the storage module can be reduced, which is beneficial to increase the pixel density.

What is claimed is:

1. A pixel circuit, comprising:

a light-emitting module;

a drive module configured to drive the light-emitting module to emit light according to a voltage of a control terminal of the drive module;

a storage module configured to store the voltage of the control terminal of the drive module; and a leakage current suppression module electrically connected to the control terminal of the drive module and configured to maintain a potential of the control terminal of the drive module, wherein the pixel circuit further comprises a data writing module and a first light-emitting control module, wherein the leakage current suppression module comprises a control terminal, a first terminal and a second terminal; and the control terminal of the leakage current suppression module is configured to input a control signal to turn on or off the leakage current suppression module;

a control terminal of the data writing module is electrically connected to a second scan signal input terminal of the pixel circuit, a first terminal of the data writing module is electrically connected to a data voltage input terminal of the pixel circuit, and a second terminal of the data writing module is electrically connected to a first terminal of the drive module;

a first terminal of the first light-emitting control module is electrically connected to a first voltage signal input terminal of the pixel circuit, a second terminal of the first light-emitting control module is electrically connected to the first terminal of the drive module, and a control terminal of the first light-emitting control module is electrically connected to a first light-emitting control signal input terminal of the pixel circuit;

the control terminal of the drive module is electrically connected to the second terminal of the leakage current suppression module, and a second terminal of the drive module is electrically connected to the first terminal of the leakage current suppression module and is further electrically connected to a first terminal of the light-emitting module; and a second terminal of the light-emitting module is electrically connected to a second voltage signal input terminal of the pixel circuit.

2. The pixel circuit of claim 1, wherein the leakage current suppression module is an oxide transistor.

3. The pixel circuit of claim 1, wherein the leakage current suppression module is further configured to write a data voltage to the control terminal of the drive module;

the control terminal of the leakage current suppression module is electrically connected to a first scan signal input terminal of the pixel circuit, the first terminal of the leakage current suppression module is electrically connected to a data voltage input terminal of the pixel circuit, and the second terminal of the leakage current suppression module is electrically connected to the control terminal of the drive module;

a first terminal of the drive module is electrically connected to a first voltage signal input terminal of the pixel circuit, a second terminal of the drive module is electrically connected to a first terminal of the light-emitting module, and a second terminal of the light-emitting module is electrically connected to a second voltage signal input terminal of the pixel circuit; and two terminals of the storage module are electrically connected to the control terminal of the drive module and the first terminal of the drive module, respectively.

4. The pixel circuit of claim 3, wherein the leakage current suppression module comprises a first transistor, the drive module comprises a second transistor, the storage module comprises a first capacitor, and the light-emitting module comprises an organic light-emitting diode, and the second transistor is a low-temperature polysilicon transistor;

a gate of the first transistor serves as the control terminal of the leakage current suppression module, a first electrode of the first transistor serves as the first terminal of the leakage current suppression module, and a second electrode of the first transistor serves as the second terminal of the leakage current suppression module;

a gate of the second transistor serves as the control terminal of the drive module, a first electrode of the second transistor serves as the first terminal of the drive module, and a second electrode of the second transistor serves as the second terminal of the drive module;

two electrode plates of the first capacitor serve as the two terminals of the storage module, respectively; and an anode and a cathode of the organic light-emitting diode serve as the first terminal and the second terminal of the light-emitting module, respectively.

5. The pixel circuit of claim 1, wherein the data writing module comprises a third transistor, the drive module comprises a fourth transistor, the leakage current suppression module comprises a fifth transistor, the first light-emitting control module comprises a sixth transistor, the storage module comprises a second capacitor, and the light-emitting module comprises an organic light-emitting diode; the third transistor, the fourth transistor and the sixth transistor are all low-temperature polysilicon transistors;

a gate of the third transistor serves as the control terminal of the data writing module, a first electrode of the third transistor serves as the first terminal of the data writing module, and a second electrode of the third transistor serves as the second terminal of the data writing module;

a gate of the fourth transistor serves as the control terminal of the drive module, a first electrode of the fourth transistor serves as the first terminal of the drive module, and a second electrode of the fourth transistor serves as the second terminal of the drive module;

a gate of the fifth transistor serves as the control terminal of the leakage current suppression module, a first electrode of the fifth transistor serves as the first terminal of the leakage current suppression module, and a second electrode of the fifth transistor serves as the second terminal of the leakage current suppression module;

a gate of the sixth transistor serves as the control terminal of the first light-emitting control module, a first electrode of the sixth transistor serves as the first terminal of the first light-emitting control module, and a second electrode of the sixth transistor serves as the second terminal of the first light-emitting control module;

two electrode plates of the second capacitor serve as two terminals of the storage module, respectively; and an anode and a cathode of the organic light-emitting diode serve as the first terminal and the second terminal of the light-emitting module, respectively.

6. The pixel circuit of claim 5, further comprising an initialization module, wherein the initialization module comprises a control terminal, a first terminal and a second terminal, the control terminal of the initialization module is electrically connected to a third scan signal input terminal of the pixel circuit, the first terminal of the initialization module is electrically connected to an initialization voltage input terminal of the pixel circuit, and the second terminal of the initialization module is electrically connected to the first terminal of the light-emitting module.

7. The pixel circuit of claim 6, wherein the initialization module comprises a seventh transistor, a gate of the seventh transistor serves as the control terminal of the initialization module, a first electrode of the seventh transistor serves as the first terminal of the initialization module, and a second terminal of the seventh transistor serves as the second terminal of the initialization module.

8. The pixel circuit of claim 7, wherein a channel type of the fifth transistor is different from a channel type of the sixth transistor, and the gate of the fifth transistor is electrically connected to the first light-emitting control signal input terminal of the pixel circuit.

9. The pixel circuit of claim 7, further comprising a second light-emitting control module, wherein a first terminal of the second light-emitting control module is electrically connected to the second terminal of the drive module, a second terminal of the second light-emitting control module is electrically connected to the first terminal of the light-emitting module, and a control terminal of the second light-emitting control module is electrically connected to a second light-emitting control signal input terminal of the pixel circuit.

10. The pixel circuit of claim 9, wherein the second light-emitting control module comprises an eighth transistor, a first electrode of the eighth transistor is electrically connected to the second electrode of the fourth transistor, a second electrode of the eighth transistor is electrically connected to the anode of the organic light-emitting device, and a gate of the eighth transistor is electrically connected to the second light-emitting control signal input terminal of the pixel circuit.

11. The pixel circuit of claim 10, wherein the third transistor, the fourth transistor, the fifth transistor, the sixth transistor, the seventh transistor and the eighth transistor are all dual-gate transistors.

12. The pixel circuit of claim 6, wherein a channel type of the fifth transistor is different from a channel type of the sixth transistor, and the gate of the fifth transistor is electrically connected to the first light-emitting control signal input terminal of the pixel circuit.

13. The pixel circuit of claim 5, wherein a channel type of the fifth transistor is different from a channel type of the sixth transistor, and the gate of the fifth transistor is electrically connected to the first light-emitting control signal input terminal of the pixel circuit.

14. The pixel circuit of claim 5, wherein the fifth transistor is an N-type transistor.

15. A display device, comprising a pixel circuit and a drive chip electrically connected to the pixel circuit;

wherein the pixel circuit comprises:

a light-emitting module;

a drive module configured to drive the light-emitting module to emit light according to a voltage of a control terminal of the drive module;

a storage module configured to store the voltage of the control terminal of the drive module; and a leakage current suppression module electrically connected to the control terminal of the drive module and configured to maintain a potential of the control terminal of the drive module, wherein the pixel circuit further comprises a data writing module and a first light-emitting control module, wherein the leakage current suppression module comprises a control terminal, a first terminal and a second terminal; and the control terminal of the leakage current suppression module is configured to input a control signal to turn on or off the leakage current suppression module;

a control terminal of the data writing module is electrically connected to a second scan signal input terminal of the pixel circuit, a first terminal of the data writing module is electrically connected to a data voltage input terminal of the pixel circuit, and a second terminal of the data writing module is electrically connected to a first terminal of the drive module;

a first terminal of the first light-emitting control module is electrically connected to a first voltage signal input terminal of the pixel circuit, a second terminal of the first light-emitting control module is electrically connected to the first terminal of the drive module, and a control terminal of the first light-emitting control module is electrically connected to a first light-emitting control signal input terminal of the pixel circuit;

the control terminal of the drive module is electrically connected to the second terminal of the leakage current suppression module, and a second terminal of the drive module is electrically connected to the first terminal of the leakage current suppression module and is further electrically connected to a first terminal of the light-emitting module; and a second terminal of the light-emitting module is electrically connected to a second voltage signal input terminal of the pixel circuit.

* * * * *